US011111723B2

(12) United States Patent
Hsieh

(10) Patent No.: US 11,111,723 B2
(45) Date of Patent: Sep. 7, 2021

(54) DOOR OPERATOR WITH HIGH-SPEED OPERATION AND FIRE ESCAPE FUNCTIONS

(71) Applicant: Chung Hsien Hsieh, New Taipei (TW)

(72) Inventor: Chung Hsien Hsieh, New Taipei (TW)

( * ) Notice: Subject to any disclaimer, the term of this patent is extended or adjusted under 35 U.S.C. 154(b) by 365 days.

(21) Appl. No.: 16/251,268

(22) Filed: Jan. 18, 2019

(65) Prior Publication Data

US 2020/0080373 A1 Mar. 12, 2020

(30) Foreign Application Priority Data

Sep. 6, 2018 (TW) ..... 107131352

(51) Int. Cl.

| | |
|---|---|
| ***E06B 9/68*** | (2006.01) |
| ***A62C 2/24*** | (2006.01) |
| ***E06B 9/80*** | (2006.01) |
| ***A62C 2/18*** | (2006.01) |

(52) U.S. Cl.

CPC ..... *E06B 9/68* (2013.01); *A62C 2/18* (2013.01); *A62C 2/247* (2013.01); *E06B 9/80* (2013.01); *E06B 2009/6809* (2013.01); *E06B 2009/807* (2013.01)

(58) Field of Classification Search

CPC ..... E06B 9/68; E06B 9/50; E06B 2009/6809; E06B 2009/907; E06B 9/82; E06B 9/56; A62C 2/18; A62C 2/247

See application file for complete search history.

(56) References Cited

U.S. PATENT DOCUMENTS

| | | | | |
|---|---|---|---|---|
| 8,230,759 | B2 * | 7/2012 | Hsieh | E05D 13/003 74/625 |
| 8,567,573 | B2 * | 10/2013 | Hsieh | E05F 15/72 188/156 |
| 9,376,864 | B2 * | 6/2016 | Hsieh | E06B 9/84 |
| 2014/0318719 | A1 * | 10/2014 | Hsieh | E05F 15/72 160/133 |
| 2017/0167194 | A1 * | 6/2017 | Freberg | E06B 9/82 |
| 2020/0080373 | A1 * | 3/2020 | Hsieh | E06B 9/70 |

FOREIGN PATENT DOCUMENTS

JP 2019206825 A 12/2019

* cited by examiner

*Primary Examiner* — Beth A Stephan

(74) *Attorney, Agent, or Firm* — McClure, Qualey & Rodack, LLP

(57) ABSTRACT

A door operator with high-speed operation and fire escape functions comprises a motor, a high-speed centrifugal brake module, a centrifugal reduction module, a central shaft locking module and a first and second clutch module. In the stationary state, the high-speed centrifugal brake module, centrifugal reduction module and central shaft locking module are connected to each other, and the drive shaft of the motor is locked by the central shaft locking module. In the normal operation, the first clutch module disengages the high-speed centrifugal brake module from the centrifugal reduction module, and the drive shaft is rotatable at high speed. In the event of fire escape, the second clutch module disengages centrifugal reduction module from central shaft locking module, and the drive shaft rotates at a lower speed. The device will provide high-speed rotation under normal operation, and automatically close the door panel at a gradually lowered speed in the event of fire escape.

10 Claims, 4 Drawing Sheets

DOOR OPERATOR WITH HIGH-SPEED OPERATION AND FIRE ESCAPE FUNCTIONS

BACKGROUND OF THE INVENTION

1. Field of the Invention

The present invention is related to a door operator with high-speed operation and fire escape functions, in particular, a door operator that can be installed on an electric rolling door for fire prevention and escape in a building in the event of a fire, and can serve as an anti-theft security system in normal time.

2. Description of the Related Art

To meet the requirements for environmental protection and energy saving, such as avoiding the leakage of air-conditioning air or heating air, and reducing waiting time of the users, the speed of opening and closing the electric rolling door during normal operation has become faster and faster. In general, the speed may be as high as 40 to 60 meters per minute.

On the other hand, in the event of a fire, sufficient time should be reserved for the people passing safely. As such, the rolling door should be slowly closed and prevented damage from the fire/smoke alarm closing. Furthermore, some countries have specific requirements for the closing speed of electric rolling door in the event of a fire.

Therefore, in normal operation, it is required that the door operator should operate at a relatively high speed, while in the event of a disaster, where the power supply is normally interrupted, the door operator should close the rolling curtain at a relatively slow speed. To perfect the operation, rigorous requirements have to be fulfilled.

At present, in order to attain the above object, two sets of door operators and two roll-up doors are normally provided. One set is for use in a normal condition, in which the motor of the door operator operates at high speed to wind up or down the rolling curtain. The other set is specially used in the event of fire escape for fire and smoke prevention. For such purpose, a simple mechanism is normally used, and the rolling curtain is allowed to drop gradually due to gravity. However, such prior art technique not only involves expensive cost, but also the mechanism involved is bulky.

SUMMARY OF THE INVENTION

The primary object of the present invention is to provide a door operator with high-speed operation and fire escape functions, which can provide high-speed operation under normal condition, and can automatically close the door curtain at a gradual slow speed when a disaster occurs.

The door operator with high-speed operation and fire escape functions according to the present invention primarily comprises: a motor having a drive shaft; a high-speed centrifugal brake module coupled to one end of the drive shaft for generating a braking force when the rotational speed of the drive shaft exceeds a predetermined rotational speed, the braking force increases in magnitude with the increase in the rotational speed; a centrifugal reduction module coupled to the high-speed centrifugal brake module for maintaining the rotational speed of the drive shaft within a predetermined range; a central shaft locking module coupled to the centrifugal reduction module for locking the drive shaft of the motor; a first clutch module disposed between the high-speed centrifugal brake module and the centrifugal reduction module, and constantly connecting the high-speed centrifugal brake module to the centrifugal reduction module; and a second clutch module disposed between the centrifugal reduction module and the central shaft locking module, and constantly connecting the centrifugal reduction module to the central shaft locking module. In a stationary state, the drive shaft of the motor is locked by the central shaft locking module. In a normal operation state of the door operator 1, the first clutch module is controlled to disengage the high-speed centrifugal brake module from the centrifugal reduction module. In the event of a disaster such as fire break out, the second clutch module is controlled to disengage the centrifugal reduction module from the central shaft locking module.

Accordingly, the present invention may switch between the stationary mode, the normal operation mode and the fire escape mode by controlling the operations of the first and second clutch module. Moreover, the high-speed centrifugal brake module can serve as a safety protection measure. In particular, when the door operator malfunctions and the door curtain drops at high speed, the door curtain may automatically decelerate to provide safety. In addition, the centrifugal reduction module serves to make the rolling curtain to drop slowly during a disaster, with or without the power supply.

BRIEF DESCRIPTION OF THE DRAWINGS

The above and further objects and novel features of this invention will more fully appear from the following detailed description with reference to the accompanied drawings, in which.

DESCRIPTION OF THE PREFERRED EMBODIMENTS

Figure 1:
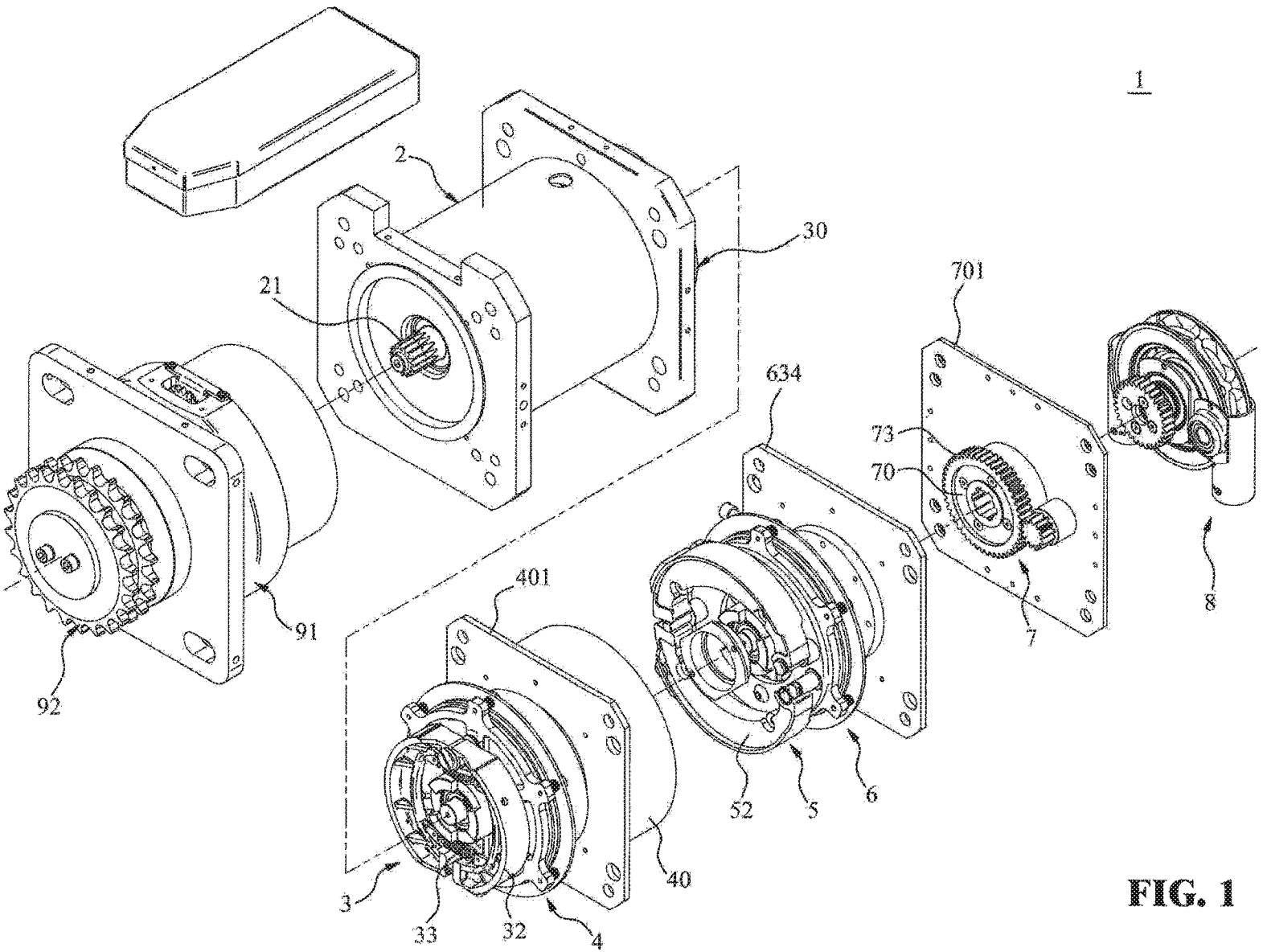
FIG. 1 is an exploded view of a preferred embodiment according to the present invention.

The present invention is related to a door operator with high-speed operation and fire escape functions. In the description hereinafter, similar elements will be denoted by the same reference numerals. Furthermore, the drawings as illustrated are merely intended to be illustrative, and are not necessarily drawn to scale, and all details of the invention are not necessarily be shown in the drawings.

Figure 2:
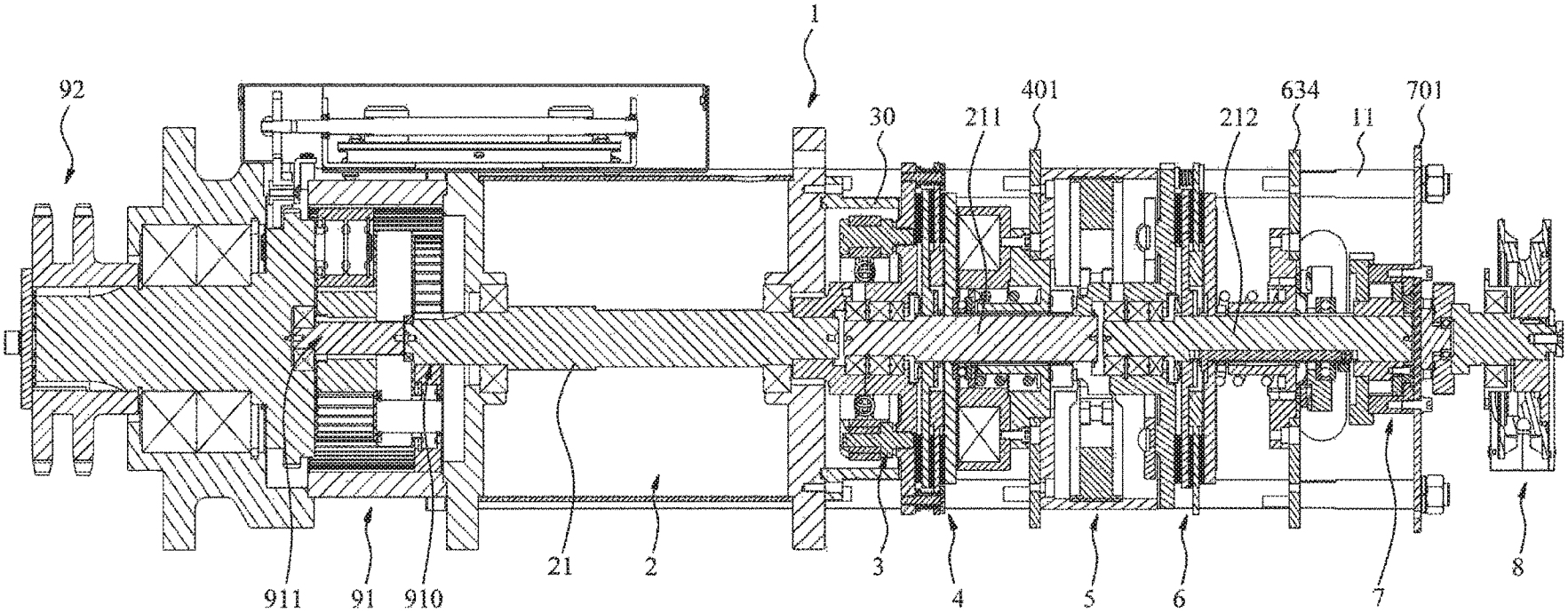
FIG. 2 is a sectional view of a preferred embodiment according to the present invention.

Referring to FIGS. 1 and 2, in which FIG. 1 is an exploded view of a preferred embodiment according to the present invention, and FIG. 2 is a sectional view of the preferred embodiment. As shown in the figures, the door operator according to this embodiment comprises the following primary components: an output shaft 92, a reduction gear module 91, an electric machine 2, a high-speed centrifugal brake module 3, a first clutch module 4, a centrifugal reduction module 5, a second clutch module 6, a central shaft locking module 7 and a manual drive module 8.

The electric machine 2 comprises a motor having a drive shaft 21 coupled at one side (shown as the left side in the figures) to the reduction gear module 91. The reduction gear module 91 provides the effect of reduction (reduction effect) by means of a plurality of gears of different specifications. The reduction gear module 91 comprises an input portion 910 connected to the drive shaft 21, and an output portion 911 connected to the output shaft 92. The output shaft 92 drives a door shaft of the rolling door (not shown) by means of a chain to wind up or drop the door curtain.

Figure 3:
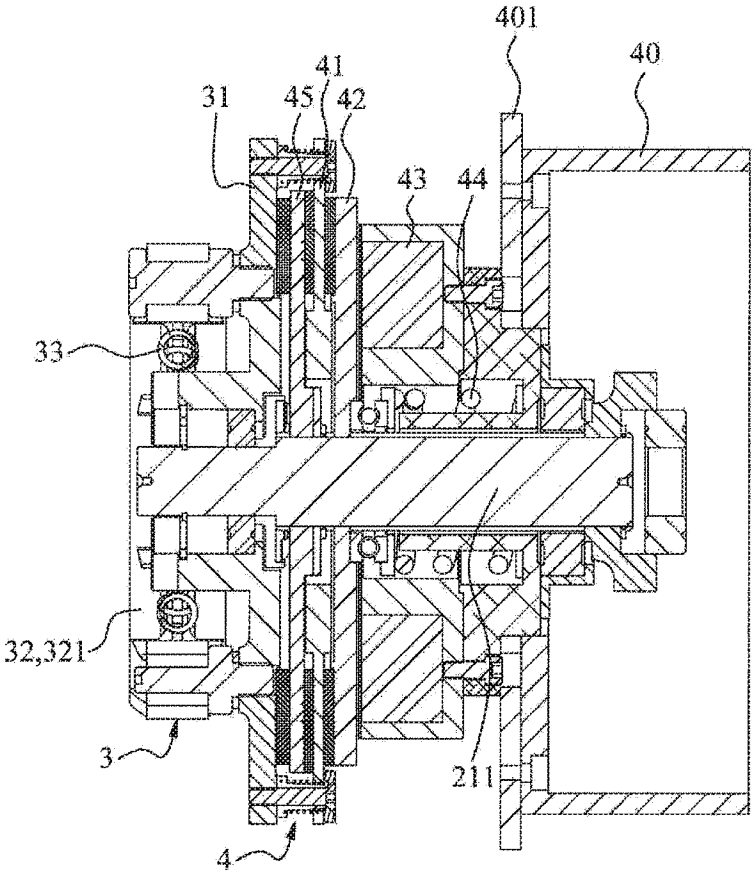
FIG. 3 is a cross-sectional view showing a high-speed centrifugal brake module and a first clutch module of a preferred embodiment according to the present invention.

Referring to FIG. 3 in conjunction with FIGS. 1 and 2, the drive shaft 21 of the motor 2 is coupled to the high-speed centrifugal brake module 3 at the other side (shown as the right side in the figures). The main function of the high-speed centrifugal brake module 3 is to prevent the fall of the door curtain at high-speed in the event that the door operator mechanism such as the brake device or the clutch device fails. The high-speed drop of the door curtain will certainly causes harm to the public and the users.

In this preferred embodiment, the high-speed centrifugal brake module 3 mainly comprises an end plate 31, an annular brake assembly 32 and a pair of springs 33. The end plate 31 is connected to the drive shaft 21 of the motor 2 to rotate therewith. The annular brake assembly 32 includes a pair of brake blocks 321. Each of the brake block 321 has one end pivotally connected to the end plate 31. Both ends of the two springs 33 are respectively connected to the two brake blocks 321, so as to urge the two brake blocks 321 to approach each other. When the end plate 31 rotates at a high speed, and exceeds a first predetermined rotational speed, which is, for example, 1800 RPM in this embodiment, the two brake blocks 321 that are subjected to the centrifugal force will overcome the tension of the spring 33, and extend radially outward to urge against the first brake ring 30 of the frame 11 of the door operator 1 to thereby generate the brake force which tends to increase in magnitude as the rotational speed increases.

The first clutch module 4 is disposed between the high-speed centrifugal brake module 3 and the centrifugal reduction module 5. The first clutch module 4 includes a first linkage shaft 211, a first rotating disc 41, a first brake disc 42, a first auxiliary brake disc 45, an electromagnetic brake 43, a first tension spring 44, and a first fixed partition plate 401. The first rotating disc 41 is connected to the end plate 31 of the high-speed centrifugal brake module 3, so as to synchronously rotate with the end plate 31 and the drive shaft 21. The first linkage shaft 211 is arranged coaxially with the drive shaft 21.

The first auxiliary brake disc 45 is mounted on the first linkage shaft 211, and located between the end plate 31 and the first rotating disc 41. The first fixed partition plate 401 is secured onto the frame 11 of the door operator 1, and the electromagnetic brake 43 is assembled on the first fixed partition plate 401. The first brake disc 42 and the first tension spring 44 are sleeved on the first linkage shaft 211. The first tension spring 44 is arranged to have one end abut against the first fixed partition plate 401, and the other end abut against the first brake disc 42, so as to constantly urge the first brake disc 42, the first rotating disc 41, the first auxiliary brake disc 45 and the end plate 31 to attach to each other. By this arrangement, the drive shaft 21, the high-speed centrifugal brake module 3, the first linkage shaft 211, and the centrifugal reduction module 5 can be rotated or braked jointly.

On the other hand, when the electromagnetic brake 43 is actuated to excitation upon the receipt of a telecommunication signal, the electromagnetic brake 43 will attract the first brake disc 42, thereby causing the first brake disc 42, the first rotating disc 41, the first auxiliary brake disc 45, and the end plate 31 to disengage from each other. At this instant, the drive shaft 21 disengages from the first linkage shaft 211, and the high-speed centrifugal brake module 3 disengages from the centrifugal reduction module 5, and thus the drive shaft 21 is freely rotatable.

Figure 4:
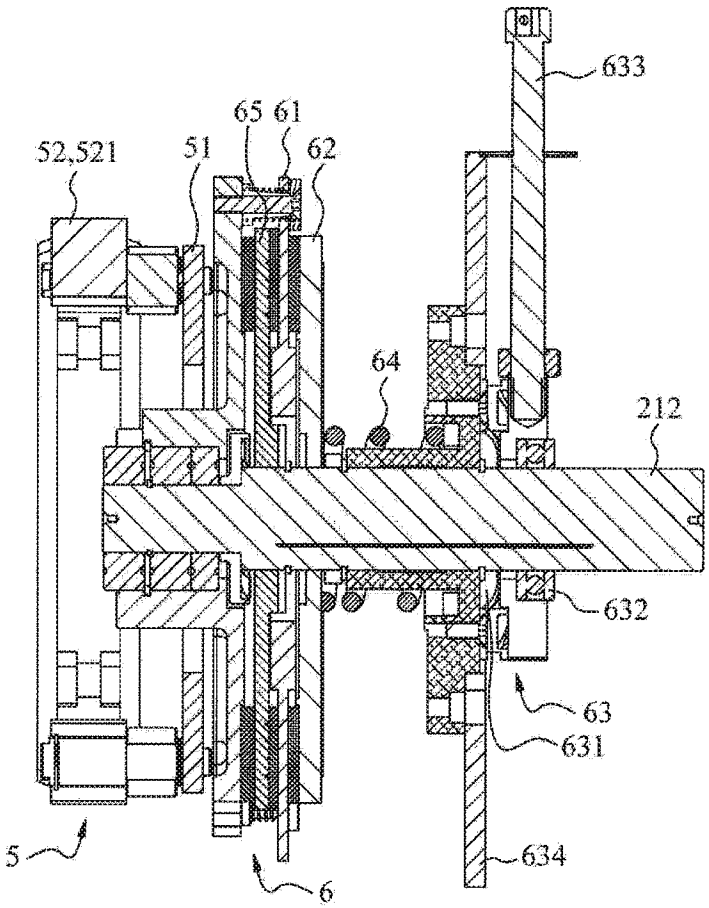
FIG. 4 is a cross-sectional view showing a centrifugal reduction module and a second clutch module of a preferred embodiment according to the present invention.

Referring now to FIGS. 2, 3 and 4, in which FIG. 2 is a cross-sectional view of a preferred embodiment according to the present invention; FIG. 3 is a cross-sectional view showing a high-speed centrifugal brake module 3 and a first clutch module 4 of a preferred embodiment according to the present invention; and FIG. 4 is a cross-sectional view showing a centrifugal reduction module 5 and a second clutch module 6 of a preferred embodiment according to the present invention. The centrifugal reduction module 5 of this embodiment is substantially similar to the afore-mentioned high-speed centrifugal brake module 3 in mechanism construction.

The centrifugal reduction module 5 of the present embodiment includes a rotating disc 51 sleeved on a first linkage shaft 211, an annular reduction assembly 52, and a spring (not shown). The annular reduction assembly 52 includes a pair of speed reduction blocks 521, with one end of each speed reduction block 521 pivotally connected to the rotating disk 51.

As such, when the first linkage shaft 211 rotates at a high speed, and exceeds a second predetermined rotational speed, which is, for example, 350 RPM in this embodiment, the two speed reduction blocks 521 that are subjected to the centrifugal force will overcome the tension of the spring (not shown), and extend radially outward to urge against the second brake ring 40 connected to the first fixed partition plate 401 to generate a braking force, and the rotational speed of the second linkage shaft 212 is maintained within a specific range of 350 RPM to 450 RPM.

Moreover, the second clutch module 6 includes a second linkage shaft 212, a second rotating disc 61, a second brake disc 62, a second auxiliary brake disc 65, a manual release mechanism 63 and a second tension spring 64. The second linkage shaft 212 is disposed coaxially with the first linkage shaft 211 and the drive shaft 21, and the second rotating disc 61 is coupled to the first linkage shaft 211 through the rotary disc 51. In addition, the manual release mechanism 63 comprises a cam retaining member 631, a cam movable member 632, a release lever 633 and a second fixed partition plate 634. The second fixed partition plate 634 is secured to the frame 11 of the door operator 1. The second brake disc 62, the second auxiliary brake disc 65 and the second tension spring 64 are sleeved on the second linkage shaft 212.

In addition, the second tension spring 64 is arranged to have one end abut against the second fixed partition plate 634, and the other end abut against the second brake disk 62, so as to constantly urge the second brake disk 62, the second rotating disk 61, and the second auxiliary brake disc 65 to attach to each other, so that the second linkage shaft 212 is coupled to the first linkage shaft 211. In addition, the cam retaining member 631 is disposed on one side of the second fixed partition plate 634, and the cam movable member 632 is sleeved on the second linkage shaft 212. The cam movable member 632 and the cam retaining member 631 are attached to each other, and the end face of the members 632 and 631 that opposes each other includes a cam surface having a mating configuration. The release lever 633 has one end coupled to the cam movable member 632, and the other end extends out of the frame 11.

As such, when the release lever 633 is actuated, the cam surface of the cam movable member 632 and that of the cam retaining member 631 will be displaced from each other, and thus overcome the resilient force of the second tension spring 64, and drive the second linkage shaft 212 to axially displace the second brake disc 62, thereby rendering the second brake disc 62 to disengage from the second rotating disc 61. At this instant, the second linkage shaft 212 disengages from the first linkage shaft 211, and the high-speed centrifugal brake module 3 and the centrifugal reduction module 5 disengage from the central shaft locking module 7, and are free to rotate.

Figure 5B:
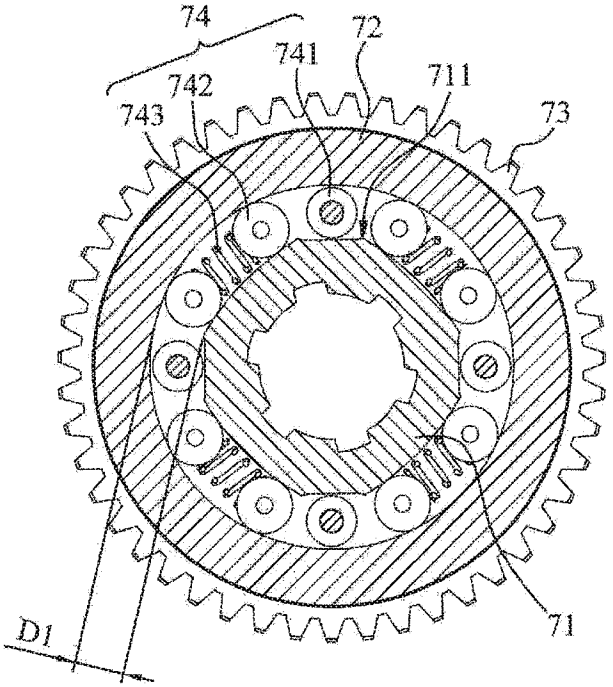
FIG. 5B is a front view of the central shaft locking module according to a preferred embodiment of the present invention, showing a state where the end cover is removed.
Figure 5A:
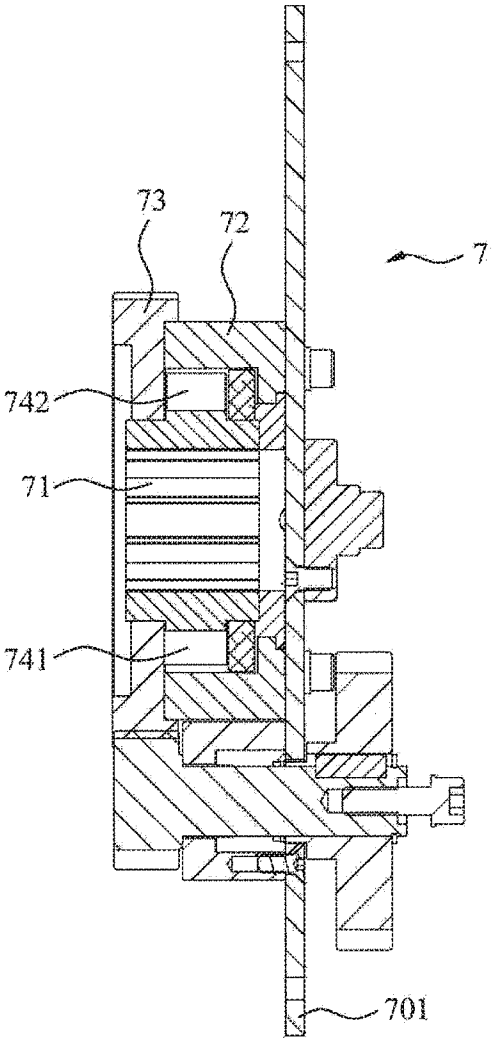
FIG. 5A is a cross-sectional view of a central shaft locking module according to a preferred embodiment of the present invention.

With reference to FIGS. 1, 2, 5A and 5B, in which FIG. 5A is a cross-sectional view of a central shaft locking module 7 according to a preferred embodiment of the present invention; and FIG. 5B is a front view of the central shaft locking module 7 according to a preferred embodiment of the present invention, showing a state where the end cover 70 is removed. The central shaft locking module 7 serves to lock the second linking shaft 212 so that the drive shaft 21 connected thereto is not rotatable. On the other hand, when the manual drive module 8 coupled to the rear side of the central shaft locking module 7 is actuated manually, the manual drive module 8 is capable of driving the second linkage shaft 212, the first linkage shaft 211 and the drive shaft 21 to rotate.

In further detail, the central shaft locking module 7 of this embodiment includes a third fixed partition plate 701, a center shaft portion 71, a stationary sleeve 72, a movable sleeve 73 and a sleeve clutch mechanism 74. The third fixed partition plate 701 is secured to the frame 11, and the center shaft portion 71 is coupled to the second linkage shaft 212. The sleeve clutch mechanism 74, the stationary sleeve 72 and the movable sleeve 73 are coaxially arranged on the center shaft portion 71 in sequential order.

The sleeve clutch mechanism 74 includes four stationary posts 741, eight movable posts 742 and four springs 743 that are disposed in between the stationary sleeve 72 and the center shaft portion 71. The stationary posts 741 are connected to the movable sleeve 73, and the stationary sleeve 72 is fixed to the third fixed partition plate 701. In addition, the center shaft portion 71 is provided with a plurality of radial convex portions 711 having convex angles. A first spacing D1 exists between the outer periphery of each radial convex portion 711 and the inner periphery of the stationary sleeve 72. The diameter of the stationary post is smaller than the first spacing D1, and the diameter of the movable post 742 is greater than the first spacing D1.

A stationary post 741 and a spring 743 are disposed alternately between two adjacent movable posts 742. In particular, as shown in FIG. 5B, for example, a stationary post 741 may be arranged in between the first pair of adjacent movable posts 742, and then a spring 743 is arranged in between the next pair of adjacent movable posts 742. Each spring 743 serves to urge the respective movable post 742 to abut the radial convex portion 711. Accordingly, when the center shaft portion 71 has the intent to rotate, as the diameter of the movable post 742 is larger than the first distance D1, the movable post 742 will be locked between the radial convex portions 711 and the stationary sleeve 72, thereby locking the center shaft portion 71. On the other hand, when the movable sleeve 73 is to be rotated, the stationary post 741 will push the movable post 742 to drive the center shaft portion 71 to rotate.

Referring now again to FIGS. 1 and 2, in the present embodiment, the manual drive module 8 is formed of a hand-driven sprocket which is coupled to the movable sleeve 73 of the central shaft locking module 7. In other words, when the user pulls the chain (not shown) to rotate the hand-driven sprocket, the movable sleeve 73 will be actuated to rotate, thereby driving the center shaft portion 71 to rotate. At the same time, the second linkage shaft 212, the first linkage shaft 211, the drive shaft 21 and the output shaft 92 connected to the center shaft portion 71 will be rotated synchronously.

The operations regarding the state of use of the present invention will be described hereinafter. Firstly, in the stationary state, the first clutch module 4 and the second clutch module 6 are not activated, so the high-speed centrifugal brake module 3, the centrifugal reduction module 5 and the central shaft locking module 7 are connected to each other. As such, the drive shaft 21, the first linkage shaft 211 and the second linkage shaft 212 are locked by the central shaft locking module 7, and are not rotatable.

In the normal operation state of the door operator 1, upon the receipt of a telecommunication signal, the first clutch module 4 is actuated, and renders the high-speed centrifugal brake module 3 disengages from the centrifugal reduction module 5. At this time, the drive shaft 21 of the motor 2 is free to rotate at high speed, and is restrained only by the high-speed centrifugal brake module 3. In other words, in the event that the interior mechanism of the door operator 1 fails, resulting in malfunction of the drive shaft 21, the high-speed centrifugal brake module 3 will provide a braking force to dampen the rotational speed of the drive shaft 21, thereby preventing the components from being damaged, or any cause of harm.

In the event of a fire escape, when a user manually operates the release lever 633 of the manual release mechanism 63 to roll down the door curtain so as to prevent the flame or smoke from spreading, the second clutch module 6 is actuated to disengage the drive shaft 21, the first linkage shaft 211 and the second linkage shaft 212 from the central shaft locking module 7. At this instant, the rotation of the drive shaft 21 is restricted by the centrifugal reduction module 5 so that its rotation speed is maintained in the range of 350 RPM to 450 RPM. That is to say, the dropping of the door curtain is maintained at the speed of 3 m/sec. to 6 m/sec. (meters per second)

The manual release mechanism 63 of the present embodiment may be replaced with a damage prevention device having a control circuit board and a battery, and the second clutch module 6 may comprise an electromagnetic clutch. In the event of a disaster, the control circuit board of the damage prevention device will trigger the second clutch module 6 to actuate.

Under the mode of manual winding up the door curtain, it generally refers to a state where the power is interrupted or the door curtain is closed in the event of a fire, and it is necessary to raise up the door curtain for escape. Under this mode, as in the stationary state, the high-speed centrifugal brake module 3, the centrifugal reduction module 5, and the central shaft locking module 7 are connected to each other, and the drive shaft 21, the first linkage shaft 211 and the second linkage shaft 212 are not rotatable as they are locked by the central shaft locking module 7. However, at this time, the user only needs to rotate the chain disc of the manual drive module 8 to drive the drive shaft 21, the first linkage shaft 211 and the second linkage shaft 212 into rotation, thereby driving the output shaft 92 to wind up the door curtain.

The preferred embodiments of the present invention are illustrative only, and are not limited to the details disclosed in the drawings and the specification. Various changes can be made by those having ordinary skill in the art without departing from the equivalent changes and modifications made by the claims of the present invention, and should belong to the scope of the present invention.

What is claimed is:

1. A door operator with high-speed operation and fire escape functions comprising: a motor having a drive shaft; a high-speed centrifugal brake module coupled to one end of the drive shaft for generating a braking force when the rotational speed of the drive shaft exceeds a predetermined rotational speed, the braking force increases in magnitude with the increase in the rotational speed; a centrifugal reduction module coupled to the high-speed centrifugal brake module for maintaining the rotational speed of the drive shaft within a predetermined range; a central shaft locking module coupled to the centrifugal reduction module for locking the drive shaft of the motor; a first clutch module disposed between the high-speed centrifugal brake module and the centrifugal reduction module, and constantly connecting the high-speed centrifugal brake module to the centrifugal reduction module; and a second clutch module disposed between the centrifugal reduction module and the central shaft locking module, and constantly connecting the centrifugal reduction module to the central shaft locking module; wherein in a stationary state, the drive shaft of the motor is locked by the central shaft locking module; in a normal operation state of the door operator, the first clutch module is controlled to disengage the high-speed centrifugal brake module from the centrifugal reduction module; and in the event of a fire escape, the second clutch module is controlled to disengage the centrifugal reduction module from the central shaft locking module.

2. The door operator according to claim 1, wherein the high-speed centrifugal brake module comprises an end plate connected to the drive shaft, an annular brake assembly having a pair of brake blocks, and at least one spring, each brake block of the pair of brake blocks has one end pivotally connected to the end plate, and another end connected to one end of the at least one spring, so that the pair of brake blocks approach each other under the action of the spring.

3. The door operator according to claim 1, wherein the first clutch module includes a first rotating disc connected to the drive shaft, a first brake disc, an electromagnetic brake secured onto a frame of the door operator, a first linkage shaft arranged coaxially with the drive shaft, and a first tension spring disposed on the first linkage shaft; the first brake disc and the centrifugal reduction module are sleeved on the first linkage shaft, the first tension spring disposed on the first linkage shaft constantly urges the first brake disc to abut the first rotating disc, so as to couple the first linkage shaft to the drive shaft;

when the electromagnetic brake operates in response to a telecommunication signal, the electromagnetic brake attracts the first brake disc, causing the first brake disc and the first linkage shaft to disengage from the first rotating disc and the drive shaft, respectively.

4. The door operator according to claim 3, wherein the centrifugal reduction module comprises a rotating disc coupled to the first linkage shaft, and an annular reduction assembly having a pair of speed reduction blocks, each of the speed reduction blocks has one end pivotally connected to the rotating disc.

5. The door operator according to claim 3, wherein the second clutch module includes a second rotating disc coupled to the first linkage shaft, a second linkage shaft coaxially disposed with the first linkage shaft, a second brake disc and a manual release mechanism sleeved on the second linkage shaft, and a second tension spring; the second tension spring is disposed on the second linkage shaft, and constantly urges the second brake disc to abut the second rotating disc, so as to couple the second linkage shaft to the first linkage shaft; when the manual release mechanism is manually operated, the second brake disc and the second linkage shaft are operated to disengage from the second rotating disc and the first linkage shaft, respectively.

6. The door operator according to claim 5, wherein the manual release mechanism comprises a cam retaining member secured to the frame of the door operator, a cam movable member disposed on the second linkage shaft, and a release lever having one end connected to the cam movable member; the cam movable member and the cam retaining member are configured to attach to each other in such a manner that an end face of the cam movable member faces an end face of the cam retaining member, the opposing end face of the cam movable member and the cam retaining member includes a cam surface having a mating configuration; whereby the release lever is operable to displace the cam surface of the cam movable member from the cam surface of the cam retaining member, so as to axially displace the second linkage shaft to disengage the second brake disc from the second rotating disc.

7. The door operator according to claim 1, further comprising a manual drive module coupled to the central shaft locking module, and manually operable to drive the drive shaft into rotation.

8. The door operator according to claim 7, wherein the central shaft locking module includes a shaft portion coaxially arranged therewith and coupled to the drive shaft, a stationary sleeve fixed to the frame of the door operator, a movable sleeve coupled to the manual drive module, and a sleeve clutch mechanism; the stationary sleeve and the sleeve clutch mechanism are arranged between the shaft portion and the movable sleeve; when the shaft portion intends to rotate, the sleeve clutch mechanism urges the shaft portion to connect with the stationary sleeve; and when the movable sleeve is to be rotated, the sleeve clutch mechanism urges the movable sleeve to drive the shaft portion into rotation.

9. The door operator according to claim 8, wherein the sleeve clutch mechanism includes at least one stationary post, in connection with the movable sleeve and at least one movable post the at least one stationary and movable post are disposed between the stationary sleeve and the shaft portion; and the shaft portion includes at least one radial convex portion, when the shaft portion intends to rotate, the movable post is locked between the radial convex portion and the stationary sleeve, thereby locking the shaft portion; when the movable sleeve is to be rotated, the stationary post pushes the movable post to drive the shaft portion to rotation.

10. The door operator according to claim 1, further comprising a reduction gear module having an input and output portion, and an output shaft coupled to the output portion; and the input portion is coupled to another end of the drive shaft.

* * * * *